US005380238A

United States Patent [19]

Crew-Gee

[11] Patent Number: 5,380,238

[45] Date of Patent: Jan. 10, 1995

[54] DOUBLE-CLOSURE CLASP

[75] Inventor: Martin P. Crew-Gee, Gatineau, Canada

[73] Assignee: Warnaco Inc., New York, N.Y.

[21] Appl. No.: 129,434

[22] Filed: Sep. 30, 1993

[51] Int. Cl.[6] ..... A41D 3/02; A41D 3/04

[52] U.S. Cl. ..... 450/36; 450/58; 2/73; 24/573.1; 24/616

[58] Field of Search ..... 2/73, 69, 105, 106, 2/115, 336; 450/58, 72, 82, 36; 24/616, 615, 632, 633, 634, 573.1, 616

[56] References Cited

U.S. PATENT DOCUMENTS

| | | | |
|---|---|---|---|
| 2,539,777 | 1/1951 | Grassmann, Sr. | 24/573.1 |
| 2,613,355 | 10/1952 | Coleman | 450/36 |
| 2,813,963 | 7/1959 | Schick | 24/616 |
| 2,912,984 | 11/1959 | Jensen . | |
| 3,002,515 | 10/1961 | Glogover . | |
| 3,196,878 | 7/1965 | Hedu . | |
| 3,200,464 | 8/1965 | Cousins | 24/616 X |
| 3,462,807 | 8/1969 | Marquardt | 24/616 |
| 3,798,711 | 3/1974 | Cousins . | |
| 4,302,049 | 11/1981 | Simpson | 24/632 X |

*Primary Examiner*—Jeanette E. Chapman

*Attorney, Agent, or Firm*—Amster Rothstein & Ebenstein

[57] ABSTRACT

A double-closure clasp for maternity, mastectomy or like garments, the clasp comprising a housing member and a pair of clip members slidably insertable in the housing; the housing being unitarily molded from plastic material and comprising a substantially flat base wall, opposed side walls and an upper wall defining a pair of adjacent apertures therethrough, the side walls, base wall and upper wall defining a pair of guideways terminating in transverse open entry slots in the housing through which the clip members are inserted. The clip members each including a substantially flat body defining a fenestration therein, and a resilient tongue extension having one end thereof integral with the body and disposed at an angle relative thereto, the tongue extension being disposed to move into and out of the fenestration, the body further including means for attachment to a portion of the garment. The garment including an elongated band adapted to encircle the body, having a pair of frontal breast supporting and encircling portions; a pair of shoulder straps attached at one end thereof to the breast supporting and encircling portions and at the opposite end thereof to the band; and a pair of breast cups integral with the band, each having a free end to which the clip members are respectively attached.

5 Claims, 3 Drawing Sheets 3
3
18
21b
26b
20b
37b
22
20a
40
16b
38
34
30
28
22
22b
20a
22a
34a
33c
34b
34c
35a
35b
35
16a
37a
24a
24
24b
21a
26a
32
33a
33b

DOUBLE-CLOSURE CLASP

BACKGROUND OF THE INVENTION

1. Field of the Invention

The present invention relates generally to a separable fastener, and more particularly, to a separable fastener adapted for any application where it is desirable to provide independent joinder of adjacent areas such as in maternity or mastectomy garments or the like, to facilitate independent exposure of either breast of the wearer without removal of the garment.

2. Description of the Prior Art

Maternity or mastectomy garments are designed to provide the ability to independently expose a single breast at a time without having to remove the entire garment. To this end, there are several patents directed to garments having special fastener provisions which permit such operation.

An example is provided in U.S. Pat. No. 3,002,515 of Oct. 3, 1961 to Glogover, which teaches a nursing brassiere for independently opening and securing either of two separable bra cups to a medial pillar with hook and eye fasteners. A similar type of nursing brassiere is disclosed in U.S. Pat. No. 2,613,355 of Oct. 14, 1952 to Coleman, in which a pair of releasable breast pockets are independently secured to a medial stay by a plurality of hook and eye fasteners. In spite of the independent closure feature in such designs, there is a drawback in that the wearer must expend time and effort to close and open a plurality of individual fastener components. This can be remedied by using a single fastener adapted to release either side of an attached portion of the garment.

It is well known in the art to employ single-closure fasteners for joining separable areas of garments. An example of such a fastener for joining separable areas in wearing apparel including brassiere cups, jewelry, drapery, or the like, is taught in U.S. Pat. No. 3,200,464 of Aug. 17, 1965 to Cousins. U.S. Pat. No. 3,798,711 of Mar. 26, 1974 to Cousins, also teaches a single-closure fastener for use with garments, jewelry, key chains, equipment or assemblies, harnesses, straps, belts, or the like. Other examples of brassieres with single-closure fasteners are disclosed in U.S. Pat. No. 3,196,878 of Jul. 27, 1965 to Hedu, and No. 2,912,984 of Nov. 17, 1959 to Jensen.

In view of the deficiencies in the prior art, there exists a need for a double-closure fastener useful with maternity, mastectomy or like garments, which, like known single-closure designs, is easy to use, and economical to manufacture.

SUMMARY OF THE INVENTION

The present invention provides a double-closure clasp generally comprised of a housing member and a pair of clip members which may be slidably received and releasably locked in opposing relationship therein. The assembly is compact, easy to use and less cumbersome than typical fasteners in the art.

The housing is unitarily molded from a suitable plastic material, e.g. Lucel polyacetol thermoplastic, nylon or the like, and is fixedly attached to a portion of the garment in a conventional manner. The housing is essentially a female element constructed and arranged to slidably receive and releasably lock the clip members in a pair of opposed clip-receiving guideways having open entry ends. In the illustrative embodiment, the housing is defined by a substantially flat base wall, a pair of opposed side walls and an apertured upper wall.

The clip members are each secured to respective adjacent free ends of the garment, such that separate portions thereof may be independently opened or closed relative to the housing. Each clip includes a substantially flat body defining a fenestration therein, and a resilient tongue extension having one end thereof integral with the body and an upper surface disposed at an angle relative thereto. Upon insertion into the respective open entry end and guideway, the tongue extension is cammed by the upper surface of the guideway into the fenestration, until fully inserted and free to spring into interlocking engagement with the housing.

In accordance with the present invention, it is an object thereof to provide a double-closure fastener comprised of a housing member which cooperates with a pair of clip members which may be independently interengaged with and releasably locked to the housing member.

It is another object of the present invention to provide a double-closure fastener suitable for use with maternity, mastectomy, or like garments, to facilitate exposing a single breast cup without having to remove the garment.

It is a further objective of the present invention to provide a double-closure fastener which permits independent closure or release of a single bra cup in an assembly requiring minimum effort and manipulation by the wearer.

It is still another object of the present invention to provide a garment having the novel fastener described in the foregoing which minimizes the likelihood of physical injury to a mother and/or infant during breastfeeding.

In accordance with these and other objects which will become apparent hereinafter, the present invention will now be described with particular reference to the accompanying drawings.

DETAILED DESCRIPTION OF THE PREFERRED EMBODIMENT

Figure 1:
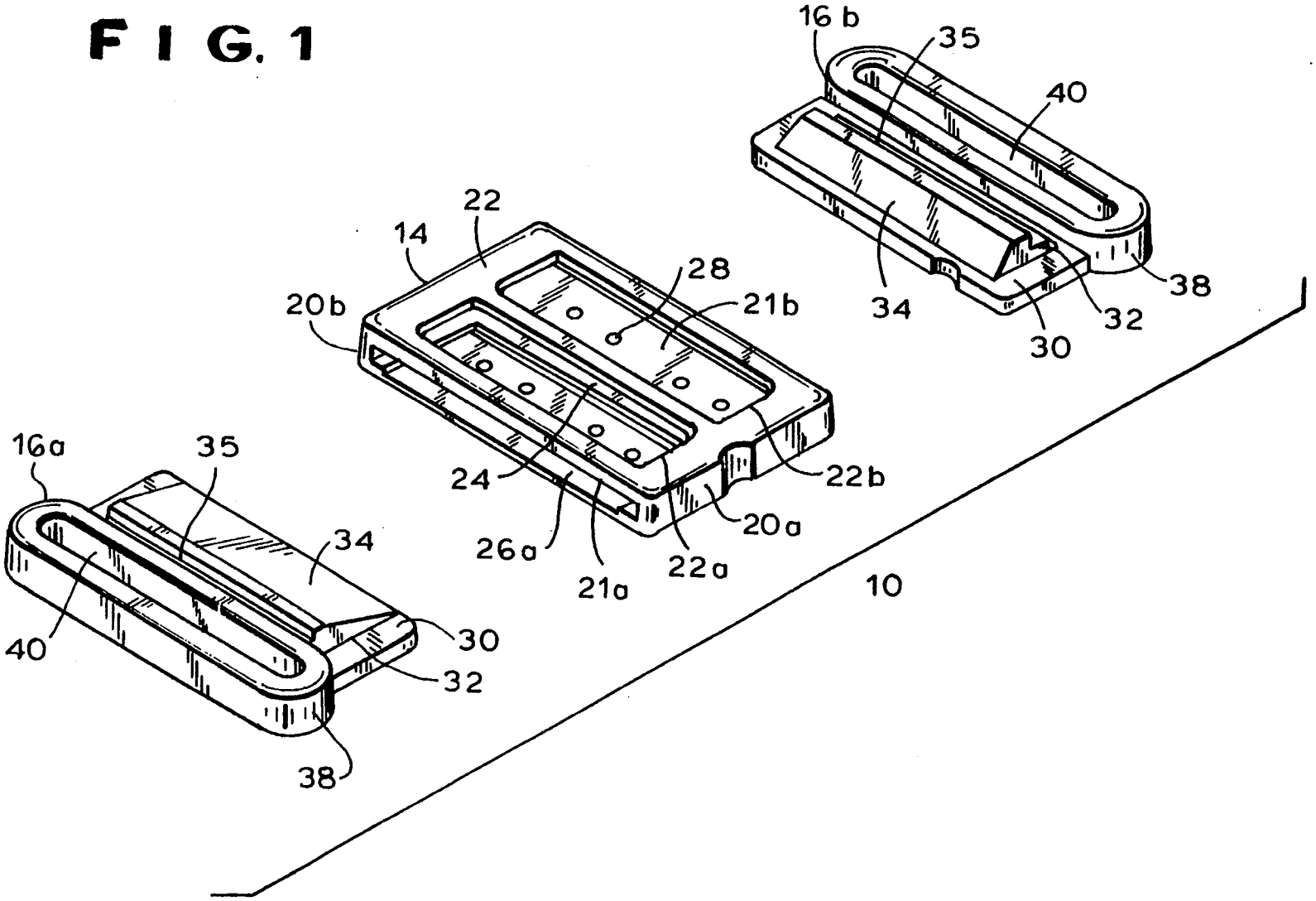
FIG. 1 is an exploded isometric view of the double-closure clasp assembly with the housing member in the center and the clip members disposed at either side thereof in an open position.

With reference to the several views in the drawings, there is depicted a double-closure clasp 10 for use with maternity, mastectomy or like garments 12. Clasp 10 is comprised of a housing member 14 and a pair of clip members 16*a* and 16*b*, respectively, which may be slidably received and releasably locked in opposing relationship therein.

Referring now to FIGS. 1, 2*a*, 2*b* and 3, housing member 14 is defined by a substantially flat base wall 18, a pair of opposed side walls 20*a*, 20*b* and an upper wall 22 defining a pair of adjacent apertures 22*a*, 22*b*, respectively therethrough. As best shown in the sectional view depicted in FIG. 3, housing 14 includes a central wall 24 which, in cooperation with side walls 20*a*, 20*b*, segregates housing 14 into symmetrical guideways 21*a*, 21*b*, forming open entry slots 26*a*, 26*b* defined by side walls 20*a*, 20*b*, base wall 18 and upper wall 22 at each end, to slidably receive therein clip members 16*a*, 16*b* respectively. Central wall 24 is constructed in the shape of an "I" section having an upper flange portion 24*a*, and a lower flange portion 24*b* integral with base wall 18. Housing 14 is attached to garment 12 as shown in FIGS. 4–7, by stitching same through a plurality of spaced holes 28 defined in base wall 18. Housing 14, and clip members 16*a*, 16*b* may be unitarily molded from plastic material, e.g., Lucel polyacetol thermoplastic, nylon (PA polyamid) or the like, by conventional molding methods such as injection or compression molding, and the extremities thereof provided with rounded-off edges to minimize physical injury to a mother and/or infant during the breast-feeding process. As an alternative to stitching, housing 14 may be fastened to garment 12 by other equivalent attachment methods which will be obvious to a person of ordinary skill in the art.

Clip members 16*a*, 16*b* are adapted to fit through respective open entry slots 26*a*, 26*b* and associated guideways 21*a*, 21*b* in housing 14, to independently secure or release a portion of the garment 12, which will be described in more detail hereinbelow. Because clip members 16*a*, 16*b* are symmetrical, it is only necessary to describe the construction and details of a single clip member, commonly identified as clip member 16.

Referring to FIG. 1, clip member 16 includes a substantially flat body 30 defining a fenestration 32 therein. Fenestration 32 includes a sloped front wall 33*a*, a rear wall 33*b* and a pair of parallel side walls 33*c*. A resilient tongue extension 34 having a sloped upper surface 34*a* is integral with and hingedly attached to body 30 along hinge line 35*a*. Tongue extension 34 includes a flat pressing area 34*b* and a step portion 34*c* proximal to free end 35*b*. Tongue extension 34 is aligned relative to fenestration 32 and disposed to move into and out of the fenestration when clip member 16 is inserted through the respective open entry slot 26*a*, 26*b* and into the associated guideway 21*a*, 21*b* in housing 14. When the clip member is inserted into the housing, the upper surface of the respective guideways 37*a*, 37*b* cams against upper surface 34*a* to urge the tongue extension 34 into fenestration 32. When fully inserted, the strain in tongue extension 34 returns it to the free position where the step portion 34*c* seats against the respective edges of apertures 22*a*, 22*b* and guideway upper surfaces 37*a*, 37*b* to provide interlocking engagement with housing 14 as shown in FIGS. 2 and 3.

Figures 2A, 2B, 3:
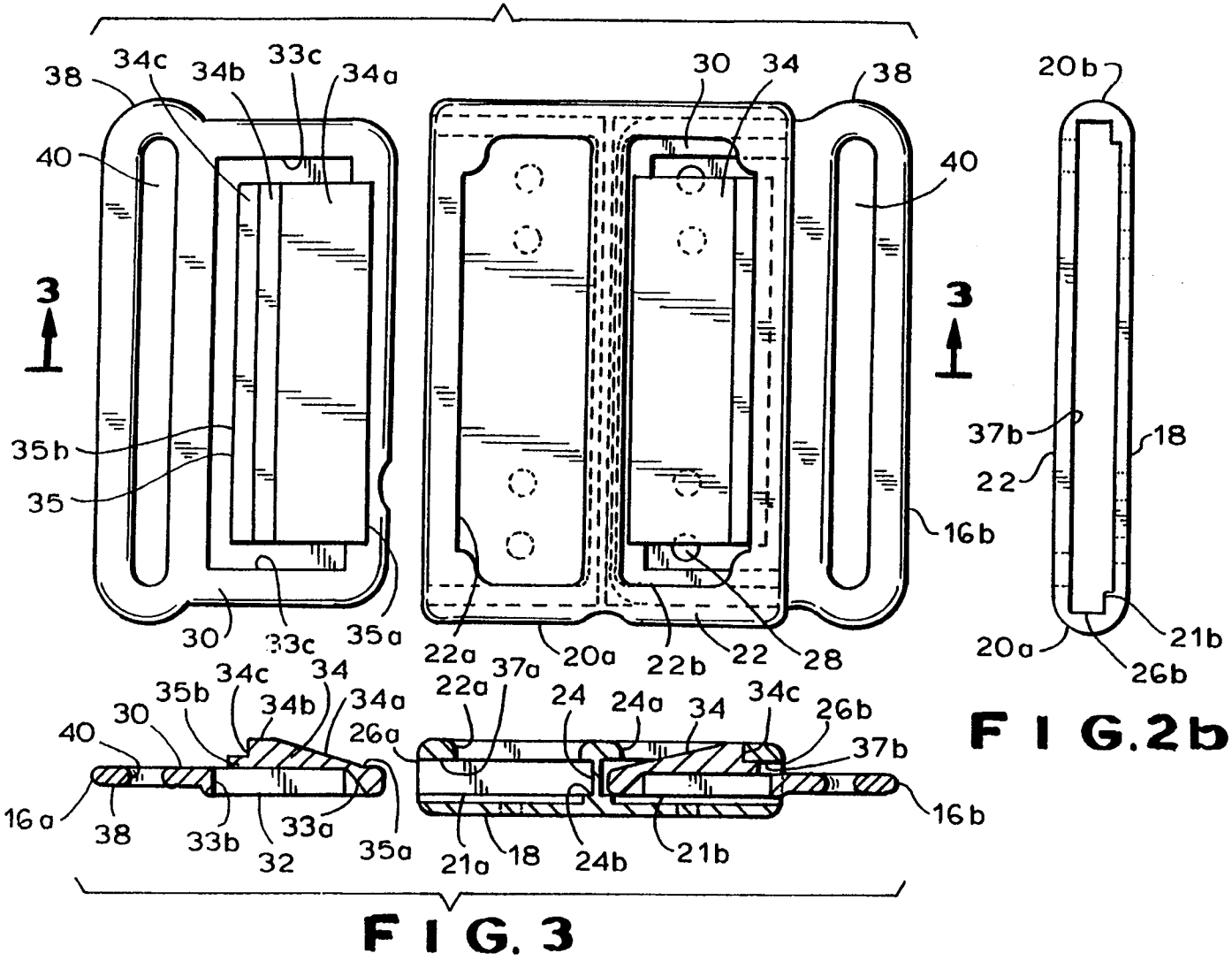
FIG. 2*a* is a top plan view of the clasp with the clip members interengaged with the housing in a locked position.
FIG. 2*b* is a right side end view of the housing member.
FIG. 3 is a sectional view along lines 3—3 in FIG. 2, depicting the interengagement of the clip members with the housing in a locked position.

To facilitate attachment to an area of garment 12, clip member 16 includes a connecting portion 38 of greater width and depth than body 30, which abuts housing 14 when the clasp is assembled as illustrated in FIGS. 2 and 3. Connecting portion 38 is provided with an elongated aperture 40 having rounded-off sides and extending therethrough generally perpendicular to the plane of body 30.

Figure 5:
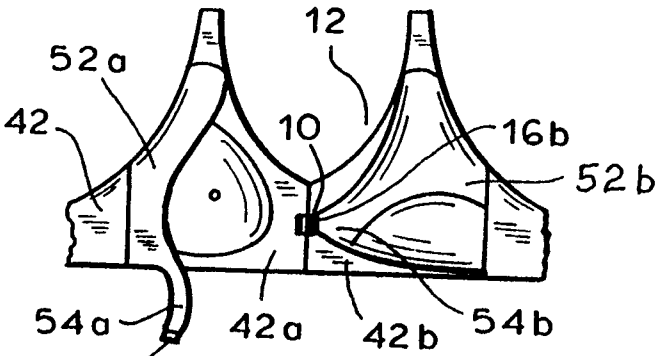
FIG. 5 is a view of the clasp as used in the first brassiere embodiment of FIG. 4 showing how one brassiere cup may be opened independently of the other.
Figure 7:
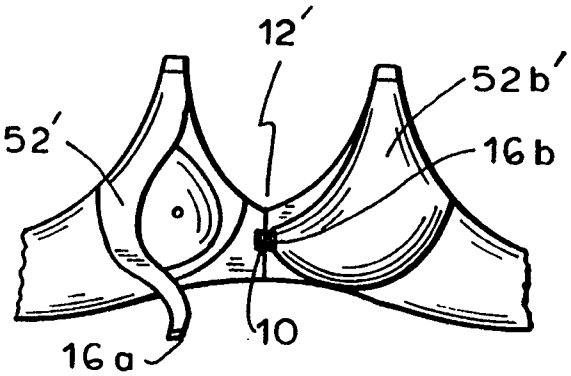
FIG. 7 is a view of the clasp as used in the second brassiere embodiment of FIG. 6 showing how one brassiere cup may be opened independently of the other.
Figure 4:
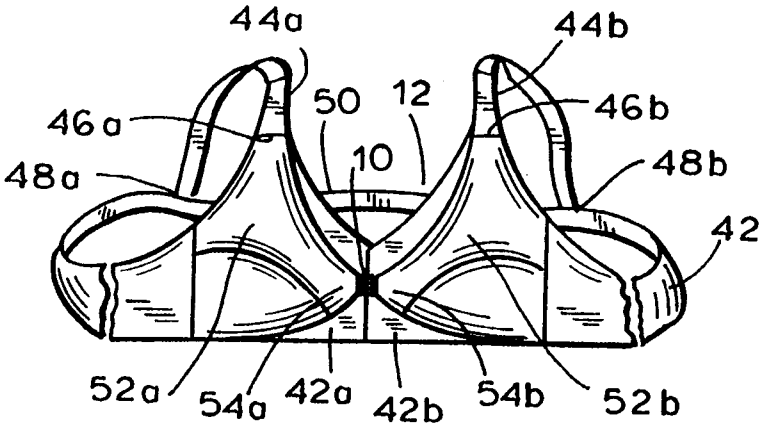
FIG. 4 is a view of the clasp in a locked position with respect to a first brassiere embodiment.
Figure 6:
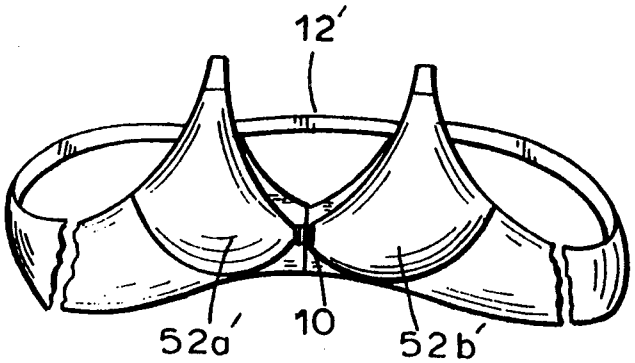
FIG. 6 is a view of the clasp in a closed position with respect to a second brassiere embodiment.

Referring now to FIGS. 4 and 5, there is depicted a first embodiment of a garment 12, with an attached double-closure clasp 10. Specifically, garment 12 includes an elongated band 42 adapted to encircle the body of the wearer, which includes a pair of breast supporting and encircling portions 42*a*, 42*b*. A pair of shoulder straps 44*a*, 44*b*, having respective first ends 46*a*, 46*b*, and respective second ends 48*a*, 48*b*, are attached to breast supporting and encircling portions 42*a*, 42*b*, at respective first ends 46*a*, 46*b* thereof, and to a rear portion 50 of band 42 at respective second ends 48*a*, 48*b* thereof. A pair of breast cups 52*a*, 52*b*, are attached on one side to respective frontal breast supporting and encircling portions 42*a*, 42*b*. Breast cups 52*a*, 52*b* include respective free ends 54*a*, 54*b* to which clip members 16*a*, 16*b* are each attached through apertures 40 defined in connecting portions 38 thereof. With reference to FIGS. 6 and 7, there is depicted an alternative garment embodiment 12' in which the breast cups 52*a'*, 52*b'* have a different shape than those illustrated in the first embodiment, but function identically in operation.

In either embodiment, clasp 10 enables the wearer to independently expose either breast while the unopened cup remains anchored to the opposite side of the clasp. The clip members are each inserted into the housing by applying pressure to the flexible tongue extension and thereafter sliding the clip member into the respective open entry slot until the tongue extension springs upwardly to interengage the housing. For release, the wearer simply depresses the flexible tongue and pulls the clip member outwardly from the housing.

The present invention has been described and disclosed in what is considered to be the most practical and preferred embodiment. It is anticipated, however, that departures may be made therefrom and that obvious modifications will occur to persons skilled in the art.

I claim:

1. A double-closure clasp attachable to a garment, comprising:

a pair of clip members, each including means for attachment thereof to the garment, said clip members further including a substantially flat body defining a fenestration therein, and a resilient tongue extension having one end thereof integral with said body and disposed at an angle relative thereto, said tongue extension being disposed to move into and out of said fenestration; and a housing member including means for attachment thereof to the garment and constructed and arranged to slidably receive and releasably lock said clip members in opposing relationship therein, said housing member being formed with oppositely directed clip-receiving guideways having open entry ends through which said clip member may be interengaged with and releasably locked to said housing member, whereby, said housing member may be fixedly attached to a center portion of the garment such that each of said clip members may be independently inserted into said guideways in said housing member through one of said respective open entry ends thereby camming said respective tongue extension until free to spring into engagement with said housing member, thereby permitting selective locking and unlocking of either of said clip members.

2. The double-closure clasp as recited in claim 1, wherein said means for attachment of each of said respective clip members to a portion of the garment include a connecting portion integral with said body, said connecting portion defining an aperture therethrough.

3. A double-closure clasp attachable to a garment, comprising:

a pair of clip members, each including means for attachment thereof to the garment, said clip members further including a substantially flat body defining a fenestration therein, and a resilient tongue extension having one end thereof integral with said body and disposed at an angle relative thereto, said tongue extension being in alignment with said fenestration, said body including means for attachment to a portion of the garment; and a housing member adapted to slidably receive and releasably lock said clip members in opposing relationship therein, said housing member comprising a substantially flat base wall, a pair of opposed side walls, and an upper wall defining a pair of adjacent apertures therethrough, said side walls, base wall and upper wall defining a pair of transverse slots in said housing, said housing member further comprising means for attachment thereof to a portion of the garment, whereby, said housing member may be fixedly attached to a center portion of the garment such that each of said clip members may be independently inserted into said housing member through one of said respective slots until said respective tongue extension is free to spring upward into said respective aperture defined in said housing, thereby permitting selective locking and unlocking of either of said clip members.

4. The double-closure clasp as recited in claim 3, wherein said means for attaching said housing member comprises fastening said housing to the garment through a plurality of apertures defined in said base wall thereof.

5. A brassiere garment, comprising:

an elongated band adapted to encircle the body, said band including a pair of frontal breast supporting and encircling portions;

a pair of shoulder straps, each having a first end and a second end, attached to said breast supporting and encircling portions of said band at said first end thereof, and a rear portion of said band at said second end thereof;

a pair of breast cups integral with said band, each of said breast cups including a free end;

a pair of clip members, each attached to said respective free ends of said breast cups and including a substantially flat body defining a fenestration therein, said clip member further including a resilient tongue extension having one end thereof integral with said body and disposed at an angle relative thereto, said tongue extension being disposed to move into and out of said fenestration; and a housing member attached to said band and constructed and arranged to slidably receive and releasably lock said clip members in opposing relationship therein, said housing member being formed with oppositely directed clip-receiving guideways having open entry ends through which said clip member may be interengaged with and releasably locked to said housing member.

* * * * *